US008360790B2

(12) United States Patent
Ju

(10) Patent No.: US 8,360,790 B2
(45) Date of Patent: Jan. 29, 2013

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/292,539

(22) Filed: Nov. 9, 2011

(65) Prior Publication Data

US 2012/0252274 A1 Oct. 4, 2012

(30) Foreign Application Priority Data

Mar. 29, 2011 (CN) ..... 2011 2 0089553 U

(51) Int. Cl.
*H01R 12/00* (2006.01)

(52) U.S. Cl. ..... 439/83; 439/66

(58) Field of Classification Search ..... 439/66, 439/83

See application file for complete search history.

(56) References Cited

U.S. PATENT DOCUMENTS 4,597,628 A * 7/1986 Seidler ..... 439/876
4,932,876 A * 6/1990 Seidler ..... 439/630
5,015,206 A * 5/1991 Dennis ..... 439/876
5,030,144 A * 7/1991 Seidler ..... 439/876
5,090,926 A * 2/1992 Seidler ..... 439/876
5,246,391 A * 9/1993 Seidler ..... 439/876
5,334,059 A * 8/1994 Seidler ..... 439/876
5,344,343 A * 9/1994 Seidler ..... 439/876
5,441,429 A * 8/1995 Seidler ..... 439/876
5,601,459 A * 2/1997 Seidler ..... 439/876
RE35,549 E * 7/1997 Seidler ..... 439/876
6,116,923 A * 9/2000 Szu ..... 439/83
6,261,136 B1 * 7/2001 Dennis ..... 439/876
6,325,644 B1 * 12/2001 Lemke et al. ..... 439/83
6,425,771 B1 * 7/2002 Shirai et al. ..... 439/83
6,461,188 B2 * 10/2002 Reul ..... 439/422
6,501,665 B1 * 12/2002 Ted ..... 361/808
6,543,129 B2 * 4/2003 Cachina et al. ..... 29/843
6,572,397 B2 * 6/2003 Ju ..... 439/342
6,641,410 B2 * 11/2003 Marvin et al. ..... 439/83
6,679,709 B2 * 1/2004 Takeuchi ..... 439/83
6,755,667 B2 * 6/2004 Lin ..... 439/83
6,969,286 B1 * 11/2005 Mongold et al. ..... 439/874
6,979,238 B1 * 12/2005 Mongold et al. ..... 439/874
6,981,884 B2 * 1/2006 Deng ..... 439/83
7,052,337 B2 * 5/2006 Mongold et al. ..... 439/874
7,125,293 B2 * 10/2006 Mongold et al. ..... 439/874
7,128,622 B2 * 10/2006 Tsai ..... 439/874
7,147,489 B1 * 12/2006 Lin ..... 439/83
7,159,312 B2 * 1/2007 Mongold et al. ..... 29/843
7,178,232 B2 * 2/2007 Mongold et al. ..... 29/843
7,695,329 B2 * 4/2010 Peloza et al. ..... 439/876
7,771,244 B1 * 8/2010 Ju ..... 439/857
7,791,443 B1 * 9/2010 Ju ..... 336/107
7,828,562 B2 * 11/2010 Wu ..... 439/83
7,837,522 B1 * 11/2010 Hoover et al. ..... 439/876
7,878,823 B2 * 2/2011 Fan ..... 439/83

(Continued)

*Primary Examiner* — Ross Gushi
(74) *Attorney, Agent, or Firm* — Morris Manning & Martin LLP; Tim Tingkang Xia, Esq.

(57) ABSTRACT

An electrical connector includes: an insulating body, having a plurality of receiving slots formed through the insulating body; a plurality of conductive terminals, each disposed in one of the receiving slots, wherein the conductive terminal is formed with a solder contact surface, and the solder contact surface is substantially vertical; and a plurality of solders, respectively received in the receiving slots, in which the solder is in a flat shape, and each of the solders is formed with an abutting surface in a flat direction for abutting the solder contact surface.

11 Claims, 6 Drawing Sheets

U.S. PATENT DOCUMENTS 7,922,548 B2 * 4/2011 Fan ..... 439/862
7,993,145 B1 * 8/2011 Howell et al. ..... 439/71
8,033,839 B2 * 10/2011 Yeh et al. ..... 439/83
8,052,433 B2 * 11/2011 Yeh ..... 439/83
8,052,434 B2 * 11/2011 Yeh et al. ..... 439/83
8,052,454 B2 * 11/2011 Polnyi ..... 439/342
8,118,603 B2 * 2/2012 Ho ..... 439/70
8,147,256 B2 * 4/2012 Jin ..... 439/83
8,177,574 B2 * 5/2012 Ju ..... 439/342
8,192,206 B1 * 6/2012 Ju ..... 439/66
8,215,998 B1 * 7/2012 Ju et al. ..... 439/660
8,221,172 B2 * 7/2012 Ju et al. ..... 439/884
8,246,360 B1 * 8/2012 Tsai et al. ..... 439/83
8,277,230 B2 * 10/2012 Huo et al. ..... 439/66
2002/0061687 A1 * 5/2002 Cachina et al. ..... 439/874
2003/0013330 A1 * 1/2003 Takeuchi ..... 439/83
2003/0102357 A1 * 6/2003 Downes ..... 228/180.1
2003/0186571 A1 * 10/2003 Lin ..... 439/83
2003/0203660 A1 * 10/2003 Kassa et al. ..... 439/65
2004/0192087 A1 * 9/2004 Ju ..... 439/83
2004/0248440 A1 * 12/2004 Deng ..... 439/83
2004/0253852 A1 * 12/2004 Regnier et al. ..... 439/83
2005/0064739 A1 * 3/2005 Searls et al. ..... 439/66
2005/0287831 A1 * 12/2005 Mongold et al. ..... 439/66
2005/0287832 A1 * 12/2005 Mongold et al. ..... 439/66
2005/0287845 A1 * 12/2005 Mongold et al. ..... 439/83
2006/0019508 A1 * 1/2006 Lin ..... 439/66
2006/0030180 A1 * 2/2006 Tsai ..... 439/83
2006/0040518 A1 * 2/2006 Ma et al. ..... 439/66
2006/0046527 A1 * 3/2006 Stone et al. ..... 439/66
2006/0094268 A1 * 5/2006 Hao ..... 439/83
2006/0116004 A1 * 6/2006 Rathburn ..... 439/66
2006/0258190 A1 * 11/2006 Chen ..... 439/83
2007/0015376 A1 * 1/2007 Szu ..... 439/66
2007/0015377 A1 * 1/2007 Lee et al. ..... 439/66
2007/0148998 A1 * 6/2007 Liao et al. ..... 439/66
2007/0218718 A1 * 9/2007 Ma ..... 439/83
2008/0108255 A1 * 5/2008 Peloza et al. ..... 439/876
2009/0023314 A1 * 1/2009 Ju ..... 439/83
2009/0263985 A1 * 10/2009 Liu et al. ..... 439/66
2009/0325398 A1 * 12/2009 Ma et al. ..... 439/66
2010/0216322 A1 * 8/2010 Fan ..... 439/83
2012/0129363 A1 * 5/2012 Wang et al. ..... 439/83
2012/0252274 A1 * 10/2012 Ju ..... 439/626

* cited by examiner

ELECTRICAL CONNECTOR

CROSS-REFERENCE TO RELATED APPLICATION

This non-provisional application claims priority under 35 U.S.C. §119(a) on Patent Application No. 201120089553.0 filed in China on Mar. 29, 2011, the entire contents of which are hereby incorporated by reference.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for electrically connecting a chip module to a circuit board.

BACKGROUND OF THE INVENTION

Along with the rapid development of computer technology, computers have increasingly higher data access capacity and data processing rate, which requires corresponding electrical connectors in the computers to have increasingly higher data transmission capability. Generally, a method for solving the problem is to increase the number of terminals in the electrical connector. Provided that the space design of electrical connectors in the related art is adopted, in order to arrange a large number of terminals in an electrical connector, the distance between terminals has to be reduced, so as to arrange the terminals at a small pitch.

Referring to FIG. 1, an electrical connector in the related art generally includes an insulating body A. The insulating body A has a plurality of receiving holes B formed through the insulating body A. Each of the receiving holes B correspondingly receives a terminal C in a flat plate shape. A lower end of the terminal C is a soldering leg c1 for being fixed to a circuit board D by soldering. The soldering leg c1 is connected with a solder E. The solder E is generally in a spherical shape. Before the electrical connector is soldered to the circuit board D, a solder paste (not shown) needs to be coated on a pad d1 of the circuit board D to serve as a pre-solder paste, and an activating agent in the solder paste cleans the oxide layer on the surface of the soldering leg c1 during soldering.

In the electrical connector of such a structure, as the terminal C is in a flat plate shape and the solder E is in a spherical shape, the solder E occupies a large space in the plate thickness direction of the terminal C, and the volume of the spherical solder E in the horizontal direction is greater than the width of the terminal C in the horizontal direction, so that the pitch between the two adjacent terminals C is limited, and small pitch arrangement of the terminals in the electrical connector cannot be achieved.

Moreover, as the coating range of the solder paste needs to cover the solder E and the entire area below the soldering leg c1, a large amount of solder paste is coated on the pad d1, which is not conducive to reducing the production cost, and as a large amount of solder paste is coated, the solder pastes of the two adjacent pads d1 easily flow around to contact each other during soldering, resulting in the risk of short circuit between the two adjacent terminals C.

Therefore, a heretofore unaddressed need exists in the art to address the aforementioned deficiencies and inadequacies.

SUMMARY OF THE INVENTION

In one aspect, the present invention is directed to an electrical connector, which can reduce the terminal pitch, and can ensure good soldering while reducing the amount of solder paste used.

In one embodiment, an electrical connector according to the present invention includes: an insulating body, having a plurality of receiving slots formed through the insulating body; a plurality of conductive terminals, each disposed in one of the receiving slots, wherein the conductive terminal is formed with a solder contact surface, and the solder contact surface is substantially vertical; and a plurality of solders, respectively received in the receiving slots, in which the solder is in a flat shape, and each of the solders is formed with an abutting surface in a flat direction for abutting the solder contact surface.

In the embodiment, the abutting surface is a plane.

Alternatively, the abutting surface is a curved surface.

Further, the conductive terminal is formed by stamping and bending a plate, and the solder contact surface is located on a surface of the conductive terminal perpendicular to a plate thickness direction.

The solder contact surface is formed by bending the conductive terminal.

In another embodiment, two opposite sides of the solder in the flat direction are each formed with an abutting surface, the conductive terminal has a pair of clamping legs extending downwards, and the two clamping legs respectively have a solder contact surface for respectively abutting the two abutting surfaces.

Further, the conductive terminal is formed by stamping and bending a plate, and the solder contact surface is located on a surface of the conductive terminal parallel to a plate thickness direction.

Two sides of the abutting surface of the solder respectively have an urging portion for urging against an inner wall of the receiving slot.

The solder is a flat sheet.

Alternatively, the solder is formed by flattening a round solder ball.

Alternatively, the solder is formed by flattening a cylindrical solder.

As compared with the related art, among other things, the present invention has the following beneficial effects. After the spherical solder in the related art is flattened to form a flat structure, the width of the solder in the horizontal direction is reduced, and accordingly the width of each conductive terminal together with the solder there-below in the horizontal plane is reduced, so that the distance between the conductive terminals on the insulating body can be reduced, which is conducive to small pitch arrangement of the terminals and high density configuration of the electrical connector. In addition, as such a solder has an abutting surface for abutting the solder contact surface, the distance between the entire solder and the solder contact surface can be reduced, which facilitates the activating agent in the solder paste to clean the oxide layer on the solder contact surface during soldering, and meanwhile reduces the amount of solder paste coated on the pad, thereby reducing the production cost and eliminating the risk of short circuit between the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
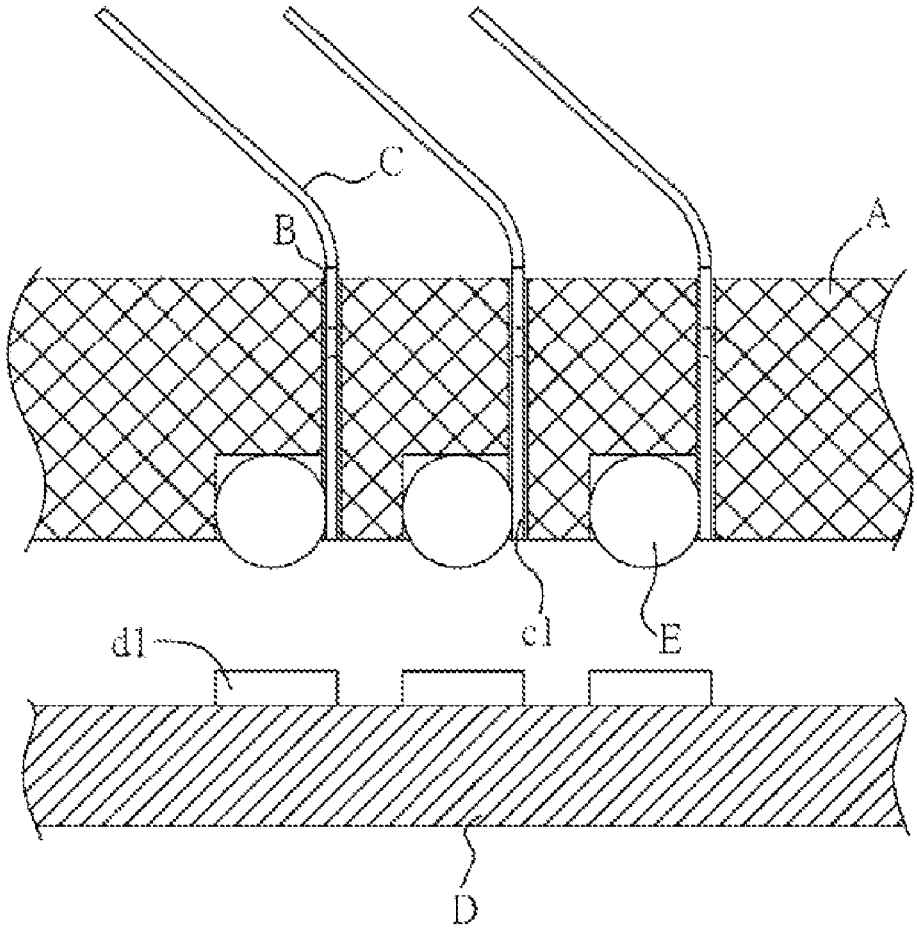
FIG. 1 (Related Art)
FIG. 1 is a schematic exploded view of an electrical connector in the related art soldered to a circuit board.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
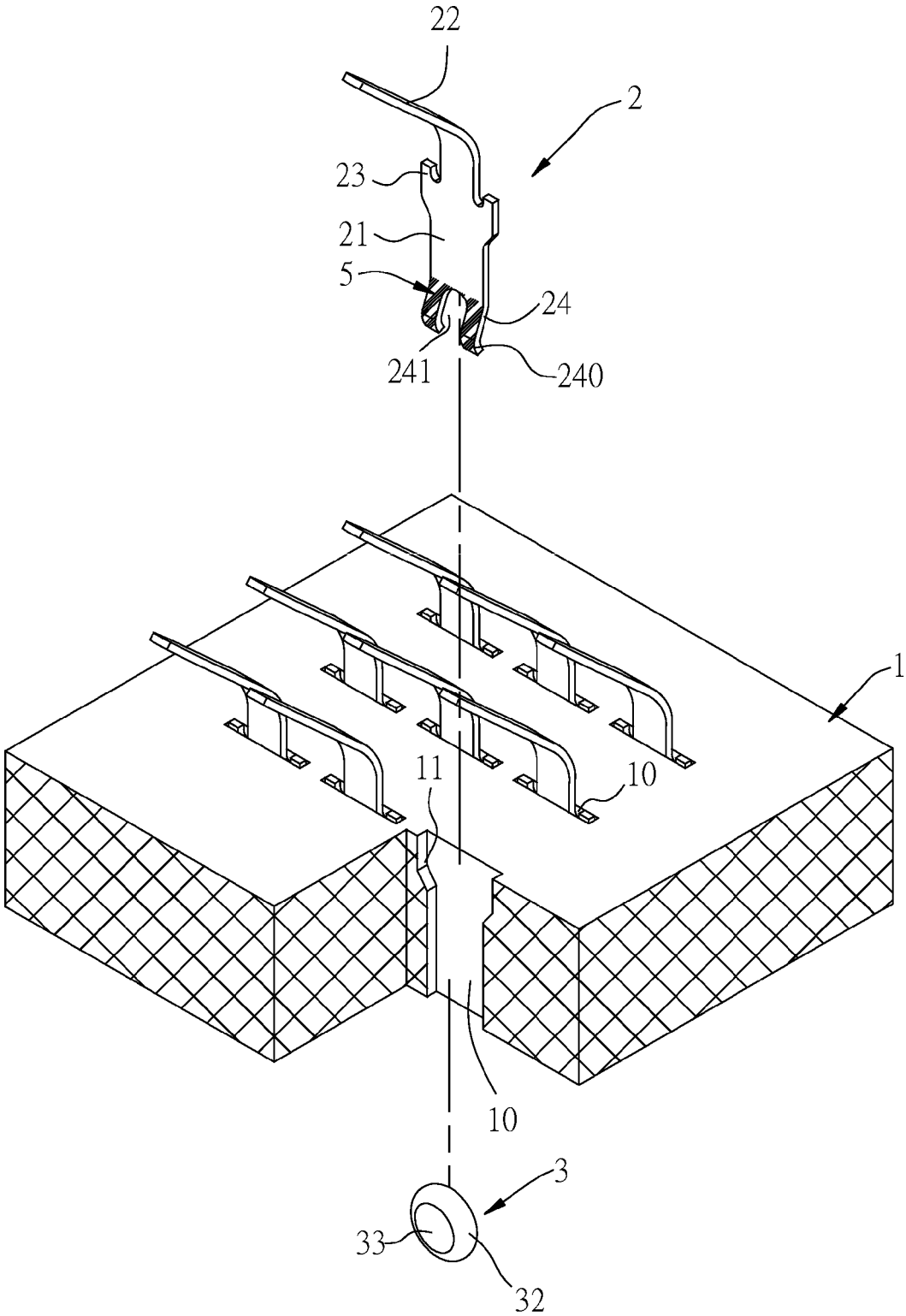
FIG. 2 is a schematic structural view of a first embodiment of the present invention.

FIG. 2 shows an electrical connector according to a first embodiment of the present invention. The electrical connector includes an insulating body 1. The insulating body 1 has a plurality of receiving slots 10 formed through the insulating body 1. Each of the receiving slots 10 correspondingly receives a conductive terminal 2. A plurality of solders 3 is correspondingly fixed to a lower end of each of the conductive terminals 2.

Figure 3:
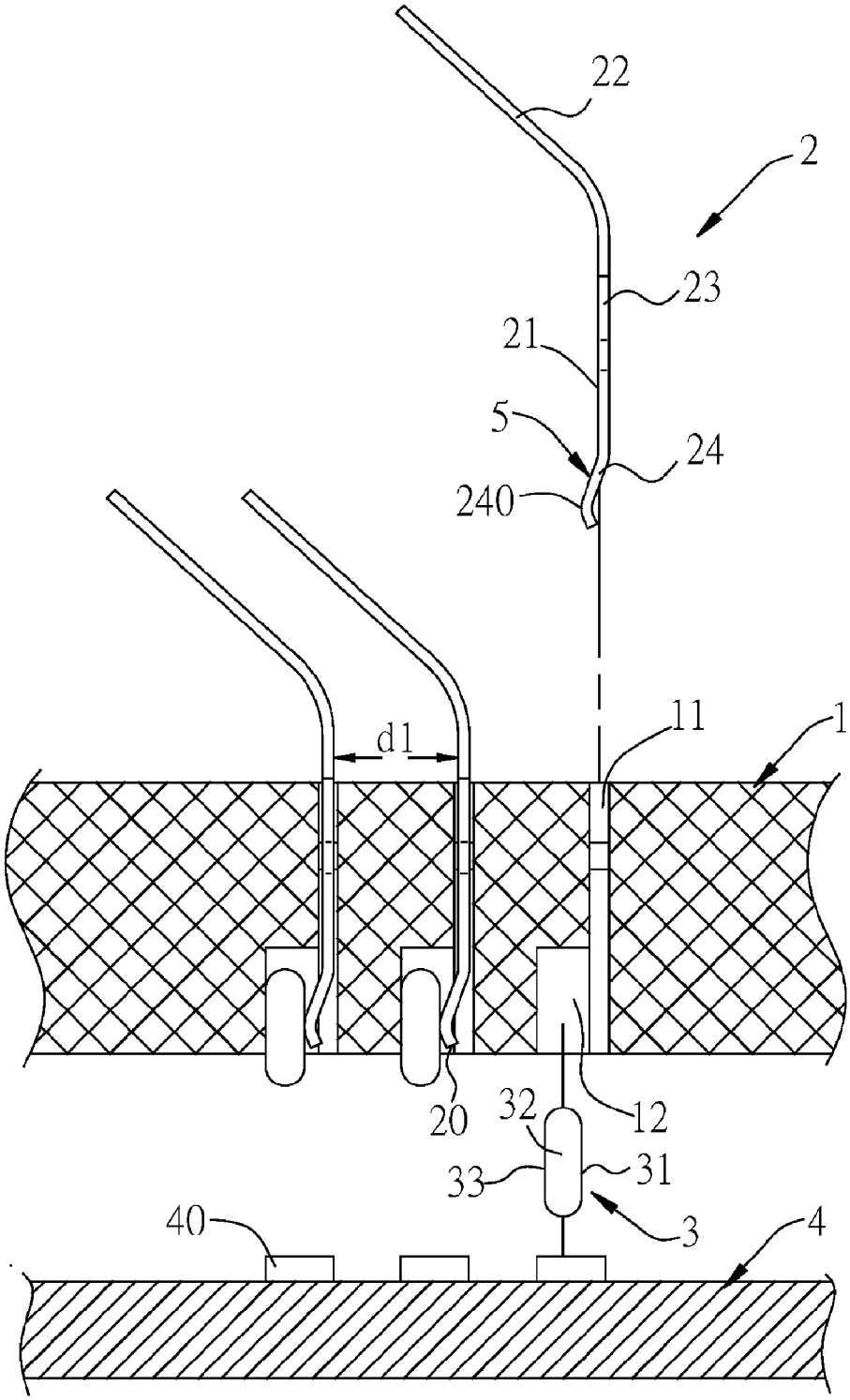
FIG. 3 is a schematic exploded view of the first embodiment of the present invention soldered to a circuit board.

Referring to FIG. 2 and FIG. 3, the receiving slots 10 are arranged on the insulating body 1 in a matrix, and formed through the insulating body 1 from top to bottom. Each of the receiving slots 10 includes a retaining slot 11 located at an upper end portion of the insulating body 1, and the retaining slot 11 is recessed in the top surface of the insulating body 1. The receiving slot 10 further includes a reserved slot 12 located at a lower end portion of the insulating body 1, and the reserved slot 12 is formed through the bottom surface of the insulating body 1, but is not formed through the top surface of the insulating body 1.

In this embodiment, the conductive terminal 2 is formed by blanking, stamping and bending a plate. Each of the conductive terminals 2 has a base 21 disposed vertically, and the base 21 is correspondingly received in one of the receiving slots 10. The conductive terminal 2 extends upwards from the base 21 and is bent to form a contact portion 22, and the contact portion 22 is exposed outside the receiving slot 10. Two sides of the base 21 respectively extend to form a retaining portion 23, the retaining portions 23 enter the retaining slot 11, and the retaining slot 11 retains the conductive terminal 2 inside the insulating body 1.

The conductive terminal 2 extends downwards from the base 21 to form a soldering portion 24. In this embodiment, the soldering portion 24 has a pair of clamping legs 240 substantially vertically extending downwards from the base 21, and the clamping legs 240 are formed by blanking, stamping and bending. The two clamping legs 240 are respectively bent along the plate thickness direction and protrude to form a curved solder contact surface 5. The solder contact surfaces 5 are located on surfaces of the two clamping legs 240 perpendicular to the plate thickness direction for correspondingly urging against the solder 3. A clearance 241 is formed between adjacent blanking surfaces of the two clamping legs 240. When the solder 3 is of a large size, the surfaces of the two clamping legs 240 do not need to be bent, so that the solder contact surface 5 is a vertically disposed plane directly contacting the solder 3, but the present invention is not limited thereto.

The lower end of the conductive terminal 2 is correspondingly disposed with a solder 3 in a flat shape received in the reserved slot 12. In this embodiment, the solder 3 is formed by flattening a round solder ball, and alternatively, the solder 3 may be formed by flattening a cylindrical solder, or a flat sheet is directly used as the solder 3, but the implementation of the present invention is not limited thereto. In this embodiment, the round solder ball has an imaginary plane parallel to the base 21 of the conductive terminal 2. After the round solder ball is flattened along the plate thickness direction of the conductive terminal 2, the imaginary plane is flattened into an elliptical shape, with a direction along the major axis thereof being a flat direction. The solder 3 is formed with an abutting surface 31 in the flat direction. The abutting surface 31 is a plane and correspondingly abuts the solder contact surface 5, and alternatively, the abutting surface 31 may also be a curved surface, but the implementation of the present invention is not limited thereto. Another side of the solder 3 opposite to the abutting surface 31 is formed with a flat surface 33, and the flat surface 33 is parallel to the abutting surface 31 and urges against an inner wall of the reserved slot 12. The solder 3 is formed with two urging portions 32 on an arc-shaped portion between the abutting surface 31 and the flat surface 33, and the two urging portions 32 urge against the inner wall of the reserved slot 12.

The two clamping legs 240 of the conductive terminal 2 are elastic, and may exert an action force on the abutting surface 31 to move the solder 3 towards the flat surface 33 so that the flat surface 33 closely urges against the inner wall of the reserved slot 12, and further through the structure of the two urging portions 32 urging against the inner wall of the reserved slot 12, the solder 3 is clamped and fixed between the soldering portion 24 and an inner wall of the receiving slot 10.

Referring to FIG. 3, a circuit board 4 is placed below the insulating body 1. A plurality of pads 40 is laid on the circuit board 4. Each of the pads 40 is correspondingly located right below the solder 3 and the conductive terminal 2. The pad 40 is coated with a solder paste (not shown). In this embodiment, the width of the solder 3 in the horizontal direction is small, so that the distance d1 between two adjacent rows of the conductive terminals 2 is reduced accordingly, which is conducive to small pitch arrangement of the terminals and high density configuration of the electrical connector.

Figure 4:
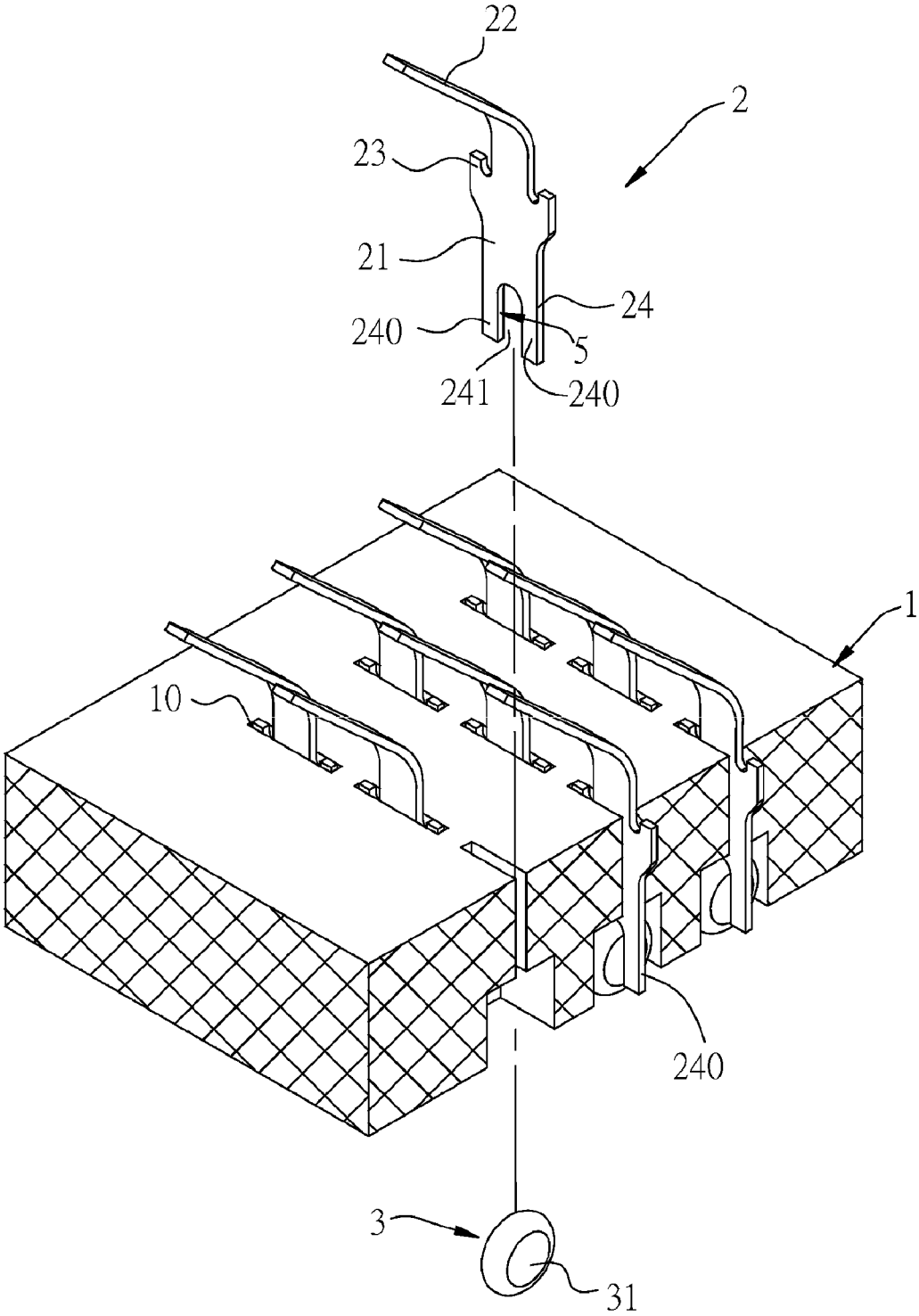
FIG. 4 is a schematic structural view of a second embodiment of the present invention.

Referring to FIG. 4, a second embodiment of the present invention has substantially the same structure as the first embodiment. The electrical connector according to the second embodiment includes an insulating body 1. The insulating body 1 has a plurality of receiving slots 10 formed through the insulating body 1. Each of the receiving slots 10 correspondingly receives a conductive terminal 2. A plurality of solders 3 is correspondingly fixed to a lower end of each of the conductive terminals 2.

Figure 5:
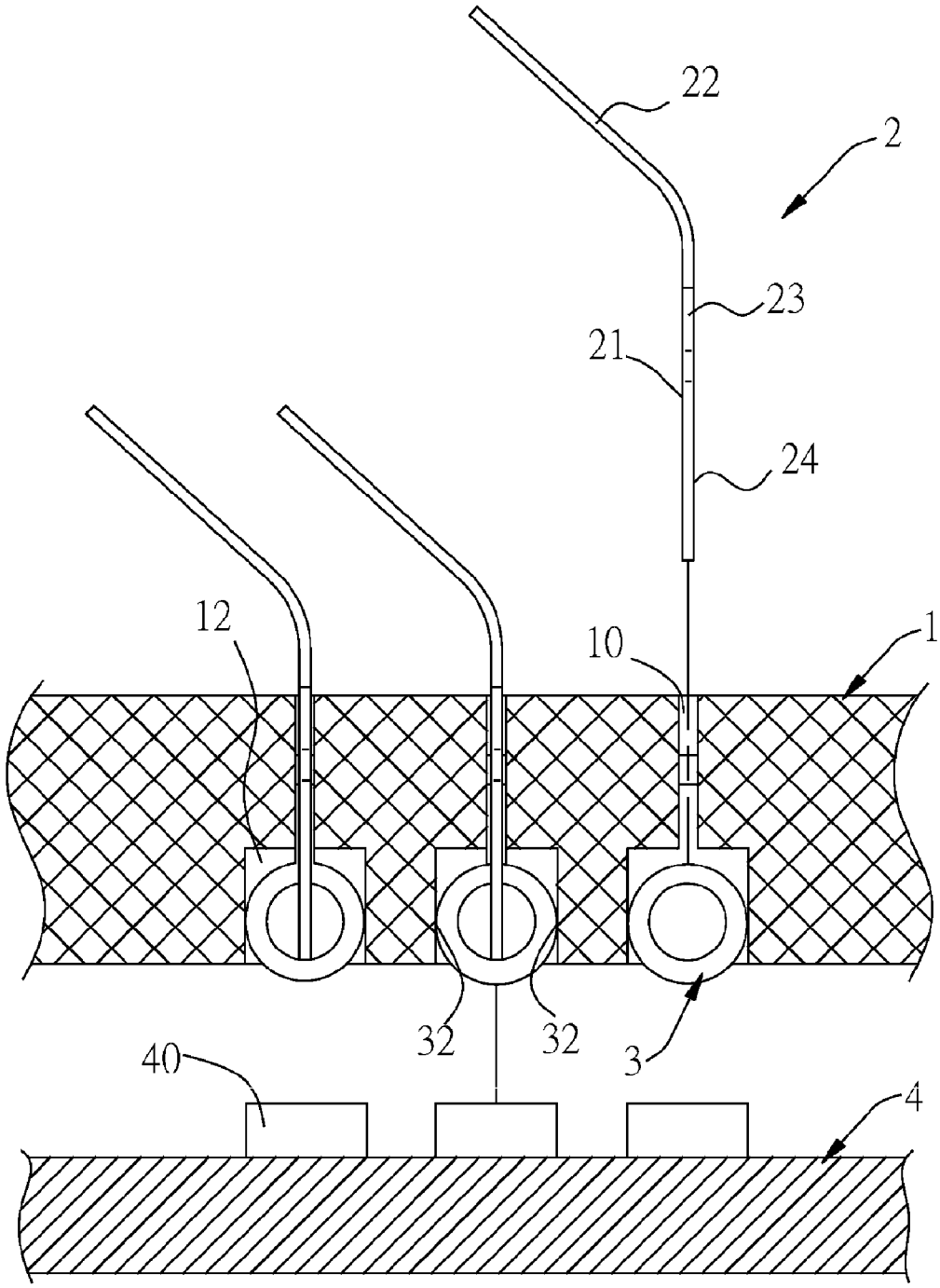
FIG. 5 is a schematic exploded view of the second embodiment of the present invention soldered to a circuit board.
Figure 6:
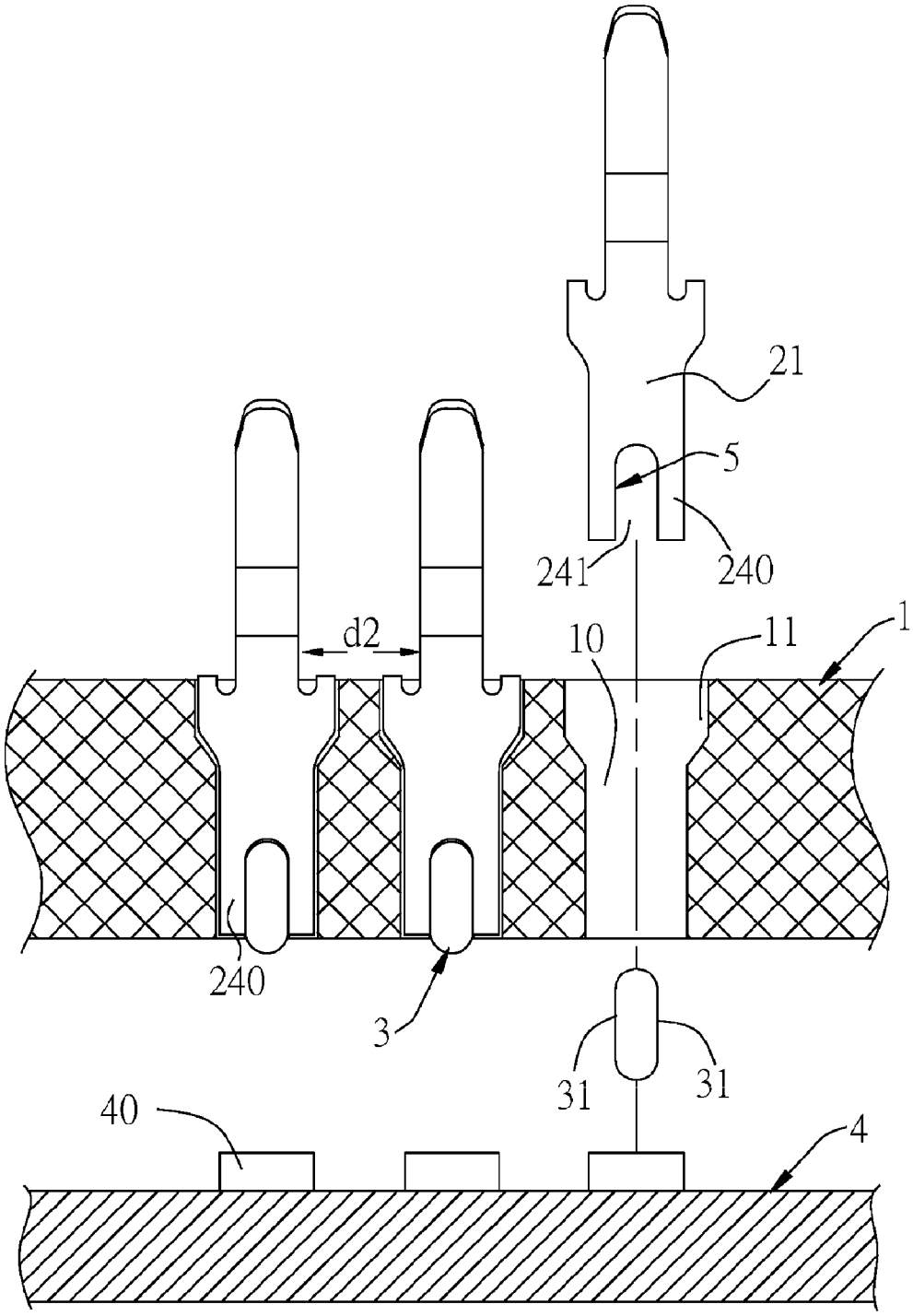
FIG. 6 is a schematic view of FIG. 5 from another angle of view.

Referring to FIG. 4 to FIG. 6, the receiving slots 10 are arranged on the insulating body 1 in a matrix, and formed through the insulating body 1 from top to bottom. Each of the receiving slots 10 includes a retaining slot 11 located at an upper end portion of the insulating body 1, and the retaining slot 11 is recessed in the top surface of the insulating body 1. The receiving slot 10 further includes a reserved slot 12 located at a lower end portion of the insulating body 1, and the reserved slot 12 is formed through the bottom surface of the insulating body 1, but is not formed through the top surface of the insulating body 1.

The conductive terminal 2 is formed by stamping and bending a plate. Each of the conductive terminals 2 has a base 21 disposed vertically, and the base 21 is correspondingly received in one of the receiving slots 10. The conductive terminal 2 extends upwards from the base 21 and is bent to form a contact portion 22, and the contact portion 22 is exposed outside the receiving slot 10. Two sides of the base 21 respectively extend to form a retaining portion 23, the retaining portions 23 enter the retaining slot 11, and the retaining slot 11 retains the conductive terminal 2 inside the insulating body 1.

Referring to FIG. 4 to FIG. 6, the conductive terminal 2 extends downwards from the base 21 to form a soldering portion 24. In this embodiment, the soldering portion 24 has a pair of clamping legs 240 vertically extending downwards from the base 21. The clamping legs 240 are formed by blanking A clearance 241 is formed between adjacent blanking surfaces of the two clamping legs 240. The blanking surface is a solder contact surface 5, and the solder contact surface 5 is parallel to the plate thickness direction of the conductive terminal 2 for correspondingly urging against the solder 3.

Referring to FIG. 5 and FIG. 6, the lower end of the conductive terminal 2 is correspondingly disposed with a solder 3 in a flat shape received in the reserved slot 12. Same as the first embodiment, the solder 3 is also formed by flattening a round solder ball. In this embodiment, the round solder ball has an imaginary plane parallel to the base 21 of the conductive terminal 2. After the round solder ball is flattened along a direction perpendicular to the plate thickness direction of the conductive terminal 2, the imaginary plane is flattened into an elliptical shape, with a direction along the major axis thereof being a flat direction. Different from the first embodiment, the solder 3 partially enters the clearance 241 and is formed with two parallel abutting surfaces 31 at two opposite sides in the flat direction, and the two abutting surfaces 31 are parallel to the two solder contact surfaces 5 and respectively abut the two solder contact surfaces 5. Moreover, the solder 33 is formed with two urging portions 32 on an arc-shaped portion between the two abutting surfaces 31. The two urging portions 32 are respectively located at two sides of the abutting surface 31 and urge against the inner wall of the reserved slot 12.

The two abutting surfaces 31 cooperate with the two urging portions 32 to clamp and position the solder 3 from different directions. In this way, the solder 3 is clamped and fixed between the soldering portion 24 and an inner wall of the receiving slot 10.

Referring to FIG. 6, a circuit board 4 is placed below the insulating body 1. A plurality of pads 40 is laid on the circuit board 4. Each of the pads 40 is correspondingly located right below the solder 3 and the conductive terminal 2, and the pad 40 is coated with a solder paste (not shown). In this embodiment, the vertical central line of the solder 3 coincides with the central line of the soldering portion 24, and the conductive terminal 2 is closer to the center of the solder paste (not shown) on the pad 40, which facilitates the activating agent in the solder paste (not shown) to clean the oxide layers on the surfaces of the two clamping legs 240 during soldering. As the two clamping legs 240 respectively have a solder contact surface 5 for respectively abutting the two opposite sides of the solder 3 in the flat direction, the width of the solder 3 in a direction perpendicular to the solder contact surface 5 is reduced, so that the distance d2 between the two adjacent conductive terminals 2 in the same row is reduced accordingly, which is conducive to small pitch arrangement of the terminals and high density configuration of the electrical connector.

The electrical connector of the present invention, among other things, has the following beneficial effects.

1. As the width of the solder 3 in the horizontal direction is reduced after the solder 3 is flattened to form a flat structure, the width of each conductive terminal 2 together with the solder 3 there-below in the horizontal plane is reduced accordingly, so that the distance between the conductive terminals 2 on the insulating body 1 can be reduced, which is conducive to small pitch arrangement of the conductive terminals 2 and high density configuration of the electrical connector.

2. As the solder 3 has an abutting surface 31 for abutting the soldering portion 24, the distance between the entire solder 3 and the soldering portion 24 can be reduced, and the conductive terminal 2 is closer to the center of the solder paste (not shown), which facilitates the activating agent in the solder paste (not shown) to clean the oxide layer on the surface of the soldering portion 24 during soldering, and meanwhile reduces the amount of solder paste coated on the pad 40, thereby reducing the production cost and eliminating the risk of short circuit between the conductive terminals 2.

3. As the solder 3 has the abutting surface 31 and the urging portion 32, the abutting surface 31 abuts and is positioned at the solder contact surface 5, the flat surface 33 urges against the inner wall of the reserved slot 12, and the urging portion 32 urges against the inner wall of the reserved slot 12, the solder 3 is clamped and positioned transversally and longitudinally, so that the solder 3 can be firmly positioned inside the receiving slot 10, thereby achieving more reliable positioning.

4. As the solder 3 partially enters the clearance 241 of the soldering portion 24, and the two abutting surfaces 31 respectively abut the two solder contact surfaces 5, the center of the solder 3 is closer to the soldering portion 24, and the conductive terminal 2 is closer to the center of the solder paste (not shown), so that the oxide layers can be cleaned more easily when the conductive terminal 2 is soldered, and meanwhile the pitch between the conductive terminals 2 and the amount of solder paste (not shown) used can be further reduced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a plurality of receiving slots formed through the insulating body;

a plurality of conductive terminals, each disposed in one of the receiving slots, wherein the conductive terminal is formed with a solder contact surface, and the solder contact surface is substantially vertical; and a plurality of solders, respectively received in the receiving slots, wherein each of the solders is in a flat shape, and formed with an abutting surface in a flat direction for abutting the solder contact surface.

2. The electrical connector according to claim 1, wherein the abutting surface is a plane.

3. The electrical connector according to claim 1, wherein the abutting surface is a curved surface.

4. The electrical connector according to claim 1, wherein the conductive terminal is formed by stamping and bending a plate, and the solder contact surface is located on a surface of the conductive terminal perpendicular to a plate thickness direction.

5. The electrical connector according to claim 4, wherein the solder contact surface is formed by bending the conductive terminal.

6. The electrical connector according to claim 1, wherein two opposite sides of the solder in the flat direction are each formed with an abutting surface, the conductive terminal has a pair of clamping legs extending downwards, and the two clamping legs respectively have a solder contact surface for respectively abutting the two abutting surfaces.

7. The electrical connector according to claim 6, wherein the conductive terminal is formed by stamping and bending a plate, and the solder contact surface is located on a surface of the conductive terminal parallel to a plate thickness direction.

8. The electrical connector according to claim 1, wherein two sides of the abutting surface of the solder respectively have an urging portion for urging against an inner wall of the receiving slot.

9. The electrical connector according to claim 1, wherein the solder is a flat sheet.

10. The electrical connector according to claim 1, wherein the solder is formed by flattening a round solder ball.

11. The electrical connector according to claim 1, wherein the solder is formed by flattening a cylindrical solder.

* * * * *